US009744639B2

(12) United States Patent
Hildebrandt et al.

(10) Patent No.: US 9,744,639 B2
(45) Date of Patent: Aug. 29, 2017

(54) PRESSING DEVICE FOR PRESSING A FINISHING BELT AGAINST A WORKPIECE SURFACE

(71) Applicant: Supfina Grieshaber GmbH & Co. KG, Wolfach (DE)

(72) Inventors: Oliver Hildebrandt, Hornberg (DE); Simon Wolber, Schiltach (DE); Michael Woehrle, Gutach (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 0 days.

(21) Appl. No.: 15/319,804

(22) PCT Filed: Jun. 25, 2015

(86) PCT No.: PCT/EP2015/064372
§ 371 (c)(1),
(2) Date: Dec. 19, 2016

(87) PCT Pub. No.: WO2016/005193
PCT Pub. Date: Jan. 14, 2016

(65) Prior Publication Data

US 2017/0151645 A1 Jun. 1, 2017

(30) Foreign Application Priority Data

Jul. 8, 2014 (DE) ..... 10 2014 213 194

(51) Int. Cl.
*B24B 21/02* (2006.01)
*B24B 5/42* (2006.01)
*B24B 21/18* (2006.01)

(52) U.S. Cl.
CPC ..... *B24B 21/02* (2013.01); *B24B 5/42* (2013.01); *B24B 21/18* (2013.01)

(58) Field of Classification Search
CPC ..... B24B 21/02; B24B 5/42; B24B 21/18
(Continued)

(56) References Cited

U.S. PATENT DOCUMENTS 3,566,549 A * 3/1971 Britton ..... B24B 23/06 451/355
5,755,615 A * 5/1998 Kiriyama ..... B24B 5/42 451/190

(Continued)

FOREIGN PATENT DOCUMENTS

DE 4444239 A1 6/1996
DE 19921043 A1 11/2000

(Continued)

*Primary Examiner* — George Nguyen
(74) *Attorney, Agent, or Firm* — Leydig, Voit & Mayer, Ltd.

(57) ABSTRACT

The invention relates to a pressing device for pressing a finishing belt against a workpiece surface, including a pressure belt and a pressure belt carrier which supports the pressure belt at two mutually spaced-apart support points, wherein the pressure belt is fastened releasably to the pressure belt carrier, wherein, in order to fix in each case one pressure belt end, provision is made of a fixing device that is provided separately from the pressure belt carrier, and wherein the fixing device is fastened or fastenable releasably to the pressure belt carrier in a state in which one pressure belt end is fixed to the fixing device.

14 Claims, 8 Drawing Sheets

(58) Field of Classification Search
USPC ..... 451/303
See application file for complete search history.

(56) References Cited

U.S. PATENT DOCUMENTS

| | | | | |
|---|---|---|---|---|
| 6,558,239 | B2 * | 5/2003 | Kunisawa | B24B 9/065 451/303 |
| 8,517,804 | B2 * | 8/2013 | Weigmann | B24B 21/02 451/168 |
| 2010/0236314 | A1 | 9/2010 | Weigmann et al. | |

FOREIGN PATENT DOCUMENTS

| | | | | |
|---|---|---|---|---|
| DE | 10332605 | A1 * | 2/2005 | B24B 5/42 |
| DE | EP 1514643 | A1 * | 3/2005 | B24B 21/02 |
| DE | 102007051047 | A1 | 4/2009 | |
| DE | 202013005504 | U1 | 6/2013 | |
| DE | 202014000094 | U1 | 2/2014 | |
| EP | 2212058 | B1 | 8/2010 | |
| GB | 2537516 | A | 10/2016 | |

* cited by examiner

PRESSING DEVICE FOR PRESSING A FINISHING BELT AGAINST A WORKPIECE SURFACE

CROSS-REFERENCE TO PRIOR APPLICATIONS

This application is a U.S. National Phase application under 35 U.S.C. §371 of International Application No. PCT/EP2015/064372, filed on Jun. 25, 2015, and claims benefit to German Patent Application No. DE 10 2014 213 194.4, filed on Jul. 8, 2014. The International application was published in German on Jan. 14, 2016 as WO 2016/005193 under PCT Article 21(2).

FIELD

The disclosure relates to a pressing device configured to press a finishing belt against a workpiece surface, including a pressure belt and a pressure belt carrier that supports the pressure belt at two spaced-apart support points, the pressure belt being releasably fastened to the pressure belt carrier.

BACKGROUND

DE 20 2013 005 504 U1 (FIG. 3) and EP 2 212 058 B1 (FIGS. 9 to 11) disclose pressing devices that allow a pressure belt to be secured to a pressure belt carrier. When the pressure belt is fitted on the pressure belt carrier, the pressure belt is positioned by its pressure belt ends on the pressure belt carrier, where is it secured by screws and clamping jaws. DE 20 2013 005 504 U1 discloses clamping jaws that are separate from the pressure belt carrier. EP 2 212 058 B1 discloses clamping jaws that are integral with the pressure belt carrier.

In the known pressing devices, it has been found that it is very time-consuming to both orient a pressure belt precisely on the pressure belt carrier and, if a pressure belt is damaged, replace the damaged pressure belt for a new pressure belt. This increases the amount of non-productive time that a device for finishing a workpiece requires prior to or while machining a workpiece.

On this basis, the problem addressed by the present disclosure is that of providing a pressing device by which the non-productive times of a device for finishing a workpiece can be shortened.

SUMMARY

This problem is solved according to the disclosure in that, to secure the pressure belt ends, one securing device, provided separately from the pressure belt carrier, is provided for each pressure belt end and in that, when in a state in which a pressure belt end is secured to the securing device, the securing device is or can be releasably fastened to the pressure belt carrier.

According to the disclosure, it is possible to handle the ends of the pressure belt at a different location from the pressure belt carrier. For this purpose, securing devices are provided that can be or are releasably fastened to the pressure belt, these securing devices making it possible to secure the pressure belt ends to their respective securing devices, separately from the pressure belt carrier. This makes it possible to connect a pressure belt end to a securing device such that the pressure belt end is secured in the securing device, this operation being carried out spatially outside a device for finishing a workpiece, and the securing device not being fastened to the pressure belt carrier until afterwards. In addition, replacement pressure belts that are already secured to separate securing devices can be kept on hand so that, if a pressure belt is damaged, the damaged pressure belt, together with the securing devices, can be replaced for a new pressure belt that is already secured in two other securing devices.

Therefore, according to the disclosure, the time-consuming installation operations associated with handling a pressure belt are carried out at a different location from the pressure belt carrier of a device for finishing a workpiece, and so the time-consuming handling operations can be carried out during operation of the finishing apparatus, i.e. during the primary processing time of the finishing device. The non-productive time associated with fitting a pressure belt are thus shortened to a time period required to releasably fasten the securing devices to the pressure belt carrier and to release the securing devices from the pressure belt carrier.

The pressure belt is secured to the securing device in a particularly reliable manner when the securing device is formed as a clamping device. When the pressure belt is secured to the securing device, the secured end of the pressure belt and the securing device cannot move relative to one another.

The pressure belt being secured to the securing device is particularly effectively if the securing device includes a clamping slot, delimited by two clamping surfaces, for receiving a pressure belt end.

Handling the pressure belt when fitting a pressure belt end on the securing device is made even simpler when the securing device includes delimiting elements for laterally delimiting the clamping slot.

Particularly preferably, two securing devices form, together with the pressure belt, a fitting unit that can be fitted as a whole on the pressure belt carrier and is releasable from the pressure belt carrier. In a fitting unit of this type, each end of the pressure belt is secured to or within its securing device, in such a way that relative movement between the pressure belt end and the securing device is not possible in the connection region between the pressure belt end and the securing device. The securing devices can still change position or location relative to one another, i.e. by the pressure belt being elastically deformed. This makes it simpler to fit the fitting unit on the pressure belt carrier and to remove the fitting unit from the pressure belt carrier.

Preferably, a plug-in connection is provided for releasably connecting the securing device to the pressure belt carrier. This allows a securing device to be fitted on the pressure belt carrier in a particularly quick and simple manner.

The plug-in connection preferably includes a plug in the form of a bearing pin and a socket in the form of a bearing pin receptacle. As a result, a sturdy plug-in connection having a simple design can be provided.

Particularly preferably, the bearing pin and the bearing pin receptacle form a pivot bearing. The connection portions for connecting the securing device and the pressure belt carrier thus perform an additional function that makes it possible to pivotally mount a securing device to the pressure belt carrier. This ability to pivot is advantageous in that a pressure belt can be arranged on the pressure belt carrier so as to at least be as tension-free as possible.

Particularly preferably, the axis of the pivot bearing extends perpendicularly to an axis of rotation of a workpiece to be machined. This ensures that the pressure belt and a finishing belt which is pressed against a workpiece surface to be machined by the pressure belt can be oriented precisely relative to the workpiece surface to be machined, without stresses occurring within the pressure belt while the workpiece surface is being machined. This improves the surface quality to be achieved when a workpiece is being finished, and increases the service life of a pressure belt.

A pressing device having a particularly simple design is produced if the bearing pin is formed on the pressure belt carrier and if the bearing pin receptacle is formed in the securing device.

To allow a securing device to be fitted on the pressure belt carrier in a particularly simple manner, it is proposed that the bearing pin receptacle includes an opening along a periphery of its bearing pin receptacle surface, that the bearing pin has a taper, based on a cylindrical shape, along a periphery of its bearing pin surface, and that the taper and the opening can be joined together. This makes it possible to join the securing device and the pressure belt carrier in a direction lateral to an insertion axis. This can thus reduce the amount a pressure belt elastically deforms while the securing devices are being fitted on and removed from the pressure belt carrier.

It is possible for the pressure belt carrier to be formed in one piece. In a preferred embodiment, however, the pressure belt carrier is in multiple parts and includes a main carrier for releasably securing the securing devices and an additional element that is movably mounted on the main carrier and by which the support points are provided. This thus provides another degree of freedom, which allows the pressure belt to be arranged on the pressure belt carrier in a tension-free manner.

Particularly preferably, the additional element is mounted on the main carrier so as to be pivotable about an additional-element pivot axis. In this way, the support points can be pivoted relative to the main carrier.

In particular, it is preferable for the additional-element pivot axis to extend in parallel with an axis of rotation of a workpiece to be machined. This allows workpieces of different diameters to be machined using the same pressing device, the additional element orienting itself on the main carrier about the additional-element pivot axis according to the diameter of a workpiece to be machined.

BRIEF DESCRIPTION OF THE DRAWINGS

The present disclosure will be described in even greater detail below based on the exemplary figures. The disclosure is not limited to the exemplary embodiments. Other features and advantages of various embodiments of the present disclosure will become apparent by reading the following detailed description with reference to the attached drawings which illustrate the following.

DETAILED DESCRIPTION

Figure 1:
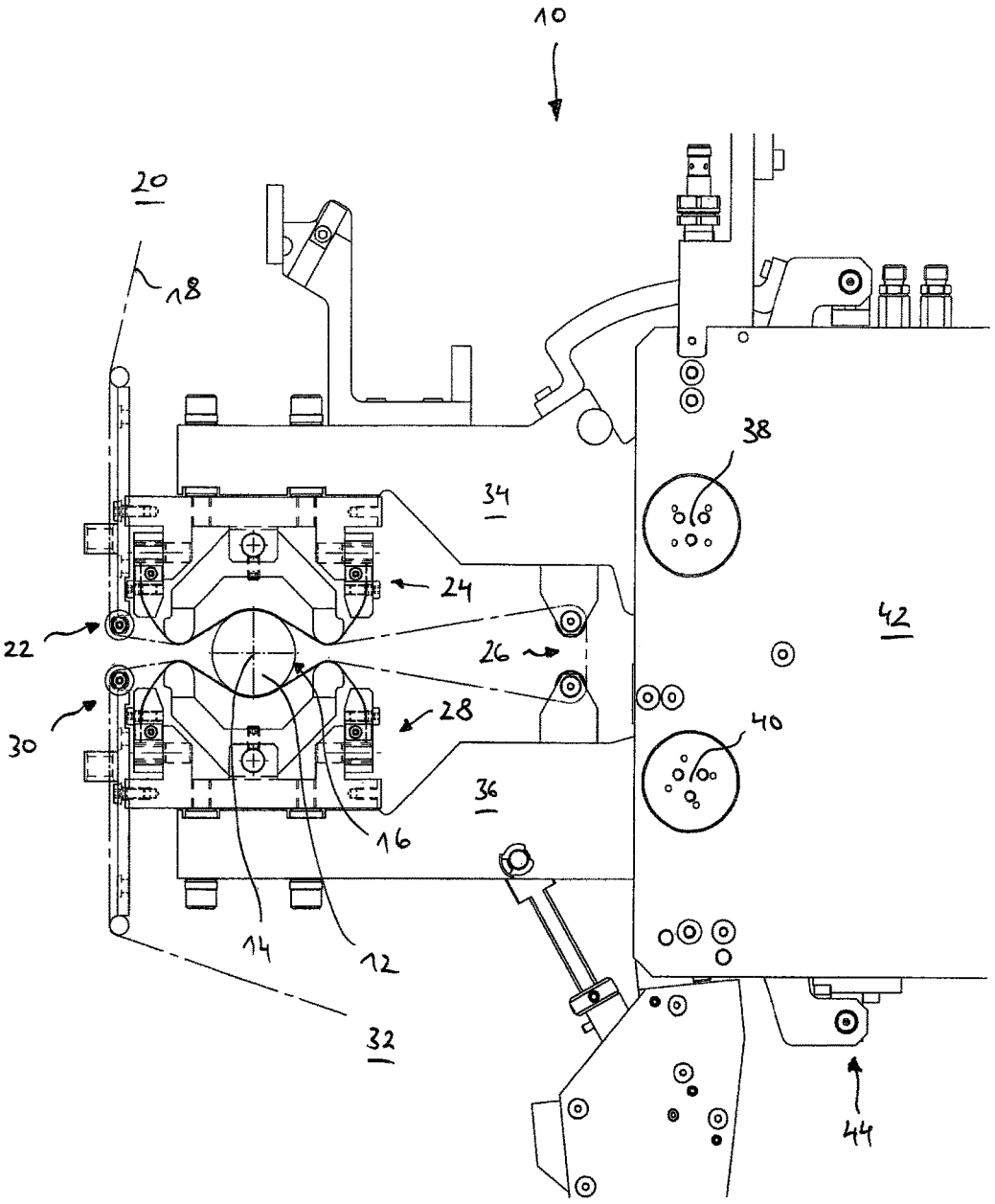
FIG. 1 is a side view of an embodiment of an apparatus for finishing a workpiece, comprising two pressing devices.

FIG. 1 shows an apparatus 10 for finishing a workpiece 12. The workpiece 12 is, for example, a crankshaft that rotates about an axis of rotation 14 while it is being finished. The workpiece surface 16 to be machined is, for example, a main bearing surface or a conrod bearing surface.

To machine the surface 16, a finishing belt 18 is provided, which is taken from a supply 20 and guided by a first guide device 22 of a first pressing device 24 and a deflection point 26. From the deflection point 26, the finishing belt 18 is guided to a second pressing device 28 and a second guide device 30, and lastly to a collector 32.

The pressing devices 24 and 28 are held on opposite sides of the workpiece 12 on respective pivot arms 34, 36 that can pivot about respective retaining-arm pivot axes 38, 40. The retaining-arm pivot axes 38, 40 are fixed with respect to a frame part 42. The frame part 42 is also used for arranging a drive device 44, which is known per se and thus only portions thereof are shown. The drive device 44 is used to press the jaw-like retaining arms 34, 36, each having their particular pressing device 24 and 28 retained thereon, towards the workpiece 12.

While the workpiece 12 is being machined, it rotates about the axis of rotation 14. The finishing belt 18 is pressed against the workpiece surface 16 to be machined at the height of each pressing device 24, 28. At the same time, an oscillating linear movement is superposed on the rotational movement of the workpiece 12 about the axis of rotation 14. In this respect, the workpiece 12 oscillates along the axis of rotation 14 relative to the finishing belt 18. This makes it possible to drive the workpiece 12 and/or the finishing belt 18 in an oscillating manner. By this oscillating movement, a cross-grinding structure typical of a finishing process is produced.

Figure 2:
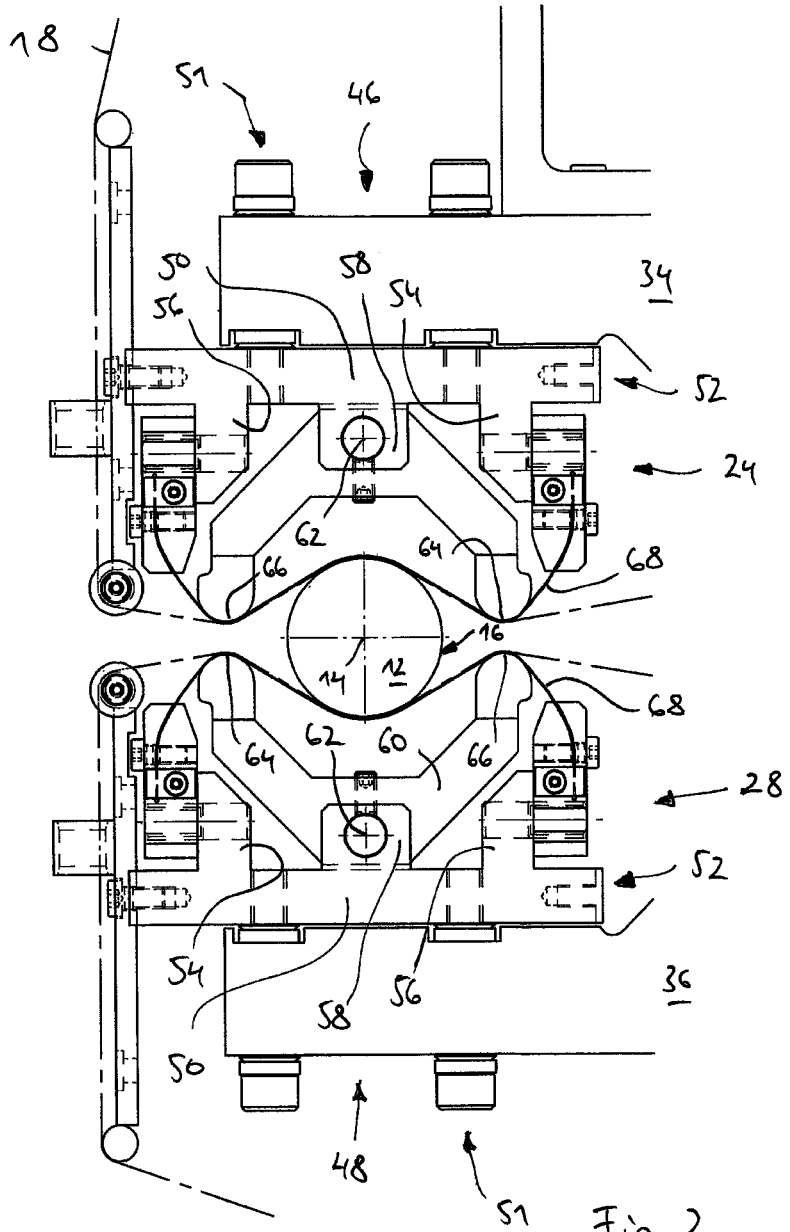
FIG. 2 shows the pressing devices according to FIG. 1 finishing a workpiece having a smaller diameter.

The design of the pressing devices 24, 28 and the connection thereof to the retaining arms 34, 36 will be explained below with reference to FIG. 2. The retaining arms 34, 36 comprise free ends 46, 48, to each of which a main carrier 50 of a pressing device 24, 28 is fastened, respectively, by a screw connection 51.

The main carrier 50 comprises a base 52 and arms 54 and 56 protruding from the base 52. A clearance that extends along the base 52 and is used to arrange a bearing bracket 58 is formed between the arms 54 and 56.

The bearing bracket 58 is used for pivotally mounting a V-shaped additional element 60. Accordingly, the additional element 60 is mounted on the main carrier 50 of the pressing device 24, 28 so as to be pivotable about an additional-element pivot axis 62.

At each of its free ends, the V-shaped additional element 60 comprises rounded support points 64, 66 that are used to support the rear face of a pressure belt 68. The pressure belt 68 is slidingly mounted in the region of the support points 64, 66

By its front face, the pressure belt 68 applies a contact pressure to the rear face of the finishing belt 18, and so the front face thereof is pressed against the workpiece surface 16 of the workpiece 12.

Figure 3:
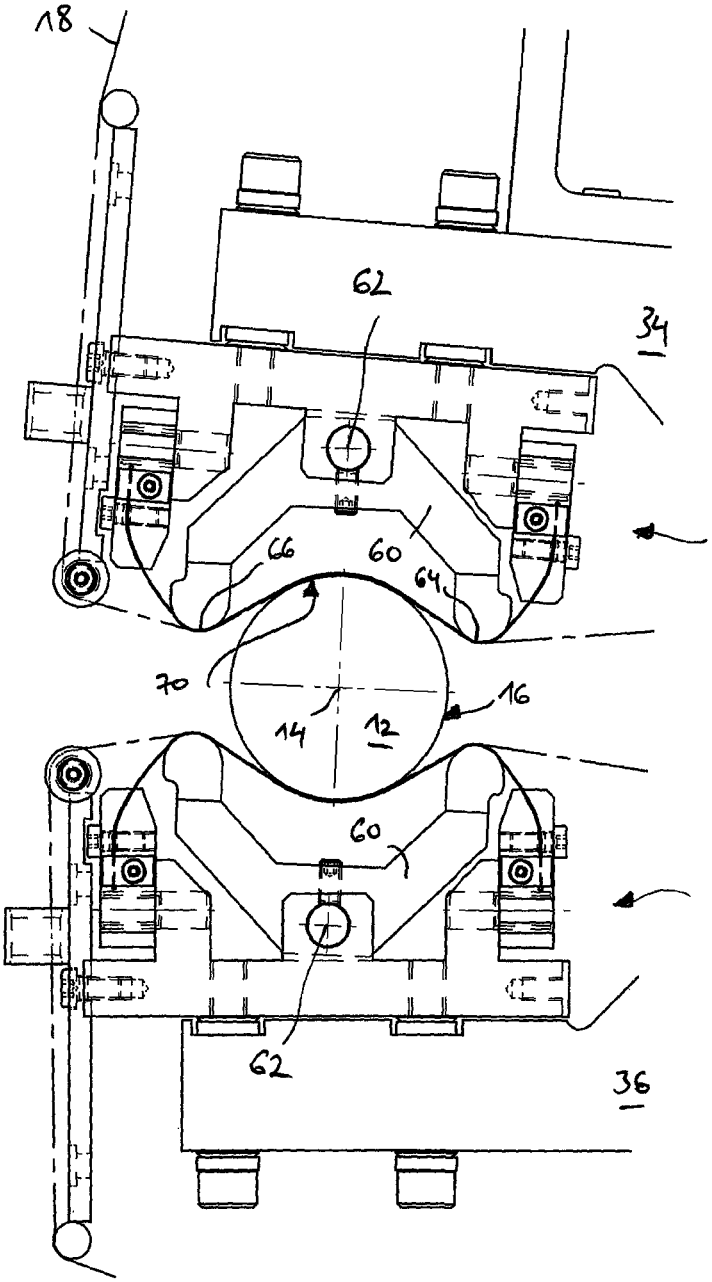
FIG. 3 is a view corresponding to FIG. 2, showing a workpiece having a larger diameter being finished.

Pivotally mounting the additional element 60 makes it possible to compensate for different opening angles of the retaining arms 34, 36 for workpieces 12 of different sizes (cf. FIGS. 2 and 3), and so a finishing portion 70 of the finishing belt 18 is oriented centrally between the support points 64, 66 in each case. This is also possible because the additional-element pivot axis 62 extends in parallel with the axis of rotation 14 of the workpiece 12.

The design of a pressing device 24, 28 will be described in the following using the example of the pressing device 24 and with reference to FIGS. 5 to 12.

To pivotally mount the additional part 60 on the main carrier 50, a pivot pin 72 is provided. The pivot pin 72 interacts with a securing screw 72, which secures the additional part 60 to the pivot pin 72. The additional element 60, the pivot pin 72 and the securing screw 74 thus form a pivoting unit that can pivot as a whole about the additional-element pivot axis 62.

Together, the additional element 60 and the main carrier 50 form a pressure belt carrier 76.

To secure the pressure belt 68 to the pressure belt carrier 76, two preferably identical securing devices 78, 80 are provided and are used to secure one pressure belt end 82, 84 of the pressure belt 68, respectively.

The securing devices 78, 80 are designed as clamping devices and each comprises a clamping slot 86 for receiving a pressure belt end 82 and 84, respectively. The pressure belt ends 82, 84 comprise a hole 88 for passing through a clamping screw 90. The clamping screw 90 is used to move material portions 92 and 94, arranged on either side of the clamping slot 86, of a securing device 78, 80 towards one another in order to narrow the clamping slot 86 such that surfaces of the material portions 92, 94 facing the pressure belt ends 82 and 84, respectively, form clamping surfaces.

To delimit the clamping slot 86 sideways, delimiting elements 96 are provided and are, for example, screwed to the material portion 94.

The material portions 92 and 94 are integral with a further material portion 98 of a securing device 78, 80.

Whereas the material portions 92 and 94 are used for securing a pressure belt end 82, 84, the material portion 98 is provided to enable a releasable connection to the pressure belt carrier 76, which will be described below.

In particular, the releasable connection between a securing device 78 and 80 and the pressure belt carrier 76 is in the form of a plug-in connection 100. The plug-in connection 100 comprises a plug in the form of a bearing pin 102, which is preferably arranged on each arm 54, 56 of the pressure belt carrier 76. The bearing pin 102 interacts with a socket in the form of a bearing pin receptacle 104, which is formed by the material portion 98 of the securing device 78, 80. The bearing pin 102 and the bearing pin receptacle 104 together form a pivot bearing 106 having an axis 108 that extends orthogonally to the axis of rotation 14 of the workpiece 12.

To fit the pressure belt 68 on the pressure belt carrier 76, a pre-shaped pressure belt (cf. FIGS. 6 and 7) is first connected to two securing devices 78, 80 by the pressure belt ends 82 and 84 being firmly clamped in respective clamping slots 86 in the securing devices 78, 80. This produces a fitting unit 110, consisting of a pressure belt 68 and two securing devices 78, 80 (cf. FIG. 8).

It is possible for the bearing pin receptacle 104 to be hollow-cylindrical and for the bearing pin 102 to be cylindrical in order together to form a plug-in connection 100.

Figure 9:
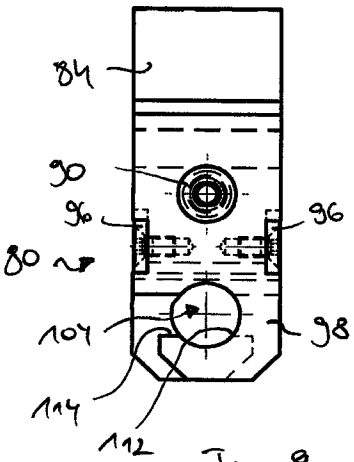
FIG. 9 is a front view of the fitting unit according to FIG. 8.
Figure 10:
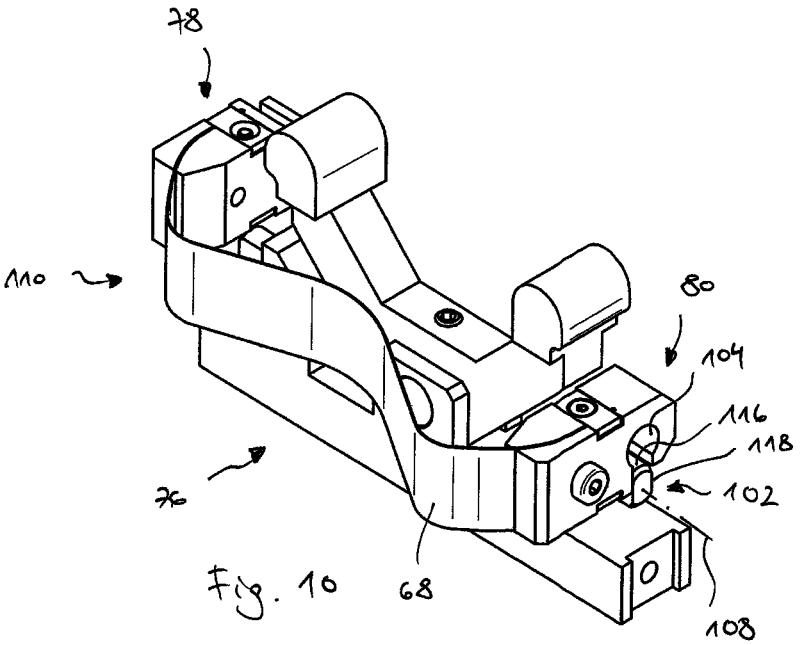
FIG. 10 is a perspective view of the pressing device according to FIGS. 4 and 5, the fitting unit according to FIGS. 8 and 9 being shown in a first fitting state.

In a preferred embodiment, however, a bearing pin receptacle surface 112 of the bearing pin receptacle 104 comprises an opening 114 when viewed in the peripheral direction (cf. FIG. 9). This opening 114 is used for allowing the bearing pin 104 to be inserted into the bearing pin receptacle 104 from a lateral direction too. For this purpose, the bearing pin 102 has a taper 118, based on a cylindrical shape, along a periphery of its bearing pin surface 116 (cf. FIGS. 10 to 12).

To releasably fasten the fitting unit 110 to the pressure belt carrier 76, the assembly 110 is positioned relative to the pressure belt carrier 76 in such a way that a first securing device 80 can be joined to a first bearing pin 102 by its bearing pin receptacle 104. For this purpose, the opening 114 in the bearing pin receptacle 104 in the first securing device 80 is oriented such that said device can be placed on the taper 118 of a first bearing pin 102. In this way, the first securing device 80 is releasably fastened to the pressure belt carrier 76 (cf. FIGS. 10 and 11).

Figure 11:
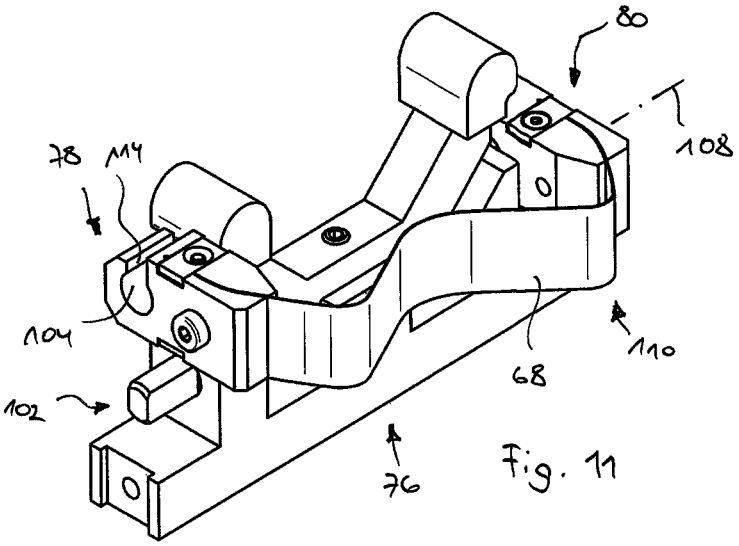
FIG. 11 is a view corresponding to FIG. 10, the fitting unit being shown in a second fitting state.
Figure 12:
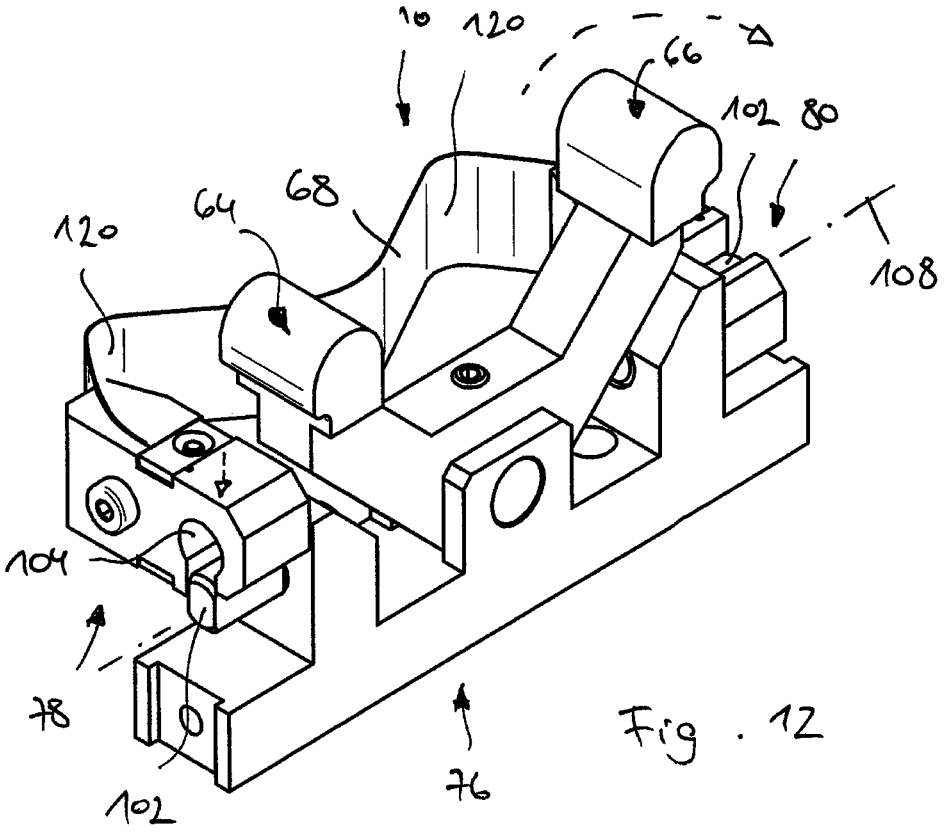
FIG. 12 is a view corresponding to FIG. 10, the fitting unit being shown in a third fitting state.

The second securing device 78 can then be joined to the pressure belt carrier 76 by the fitting unit 110 being pivoted by 180° about the pivot axis 108 of the first securing device 80 (cf. FIGS. 11 and 12). In this way, the opening 114 in the bearing pin receptacle 104 in the first securing device 78 can be brought into the joining position with the second bearing pin 102 of the pressure belt carrier 76 (cf. FIG. 12). From here, the second bearing pin 102 and the bearing pin receptacle 104 of the second securing device 78 can be joined together, as indicated by the dashed arrow in FIG. 12.

Starting from a state in which the securing devices 78 and 80 are each releasably fastened to the pressure belt carrier 76, and in which the bearing pins 102 are received in the respective bearing pin receptacles 104, the fitting unit 110 can be pivoted by 90° about the axis 108 in order to complete the fitting, as indicated by a dashed pivot arrow in FIG. 12. This produces the completely fitted pressing device 24 shown in FIG. 4.

Figure 4:
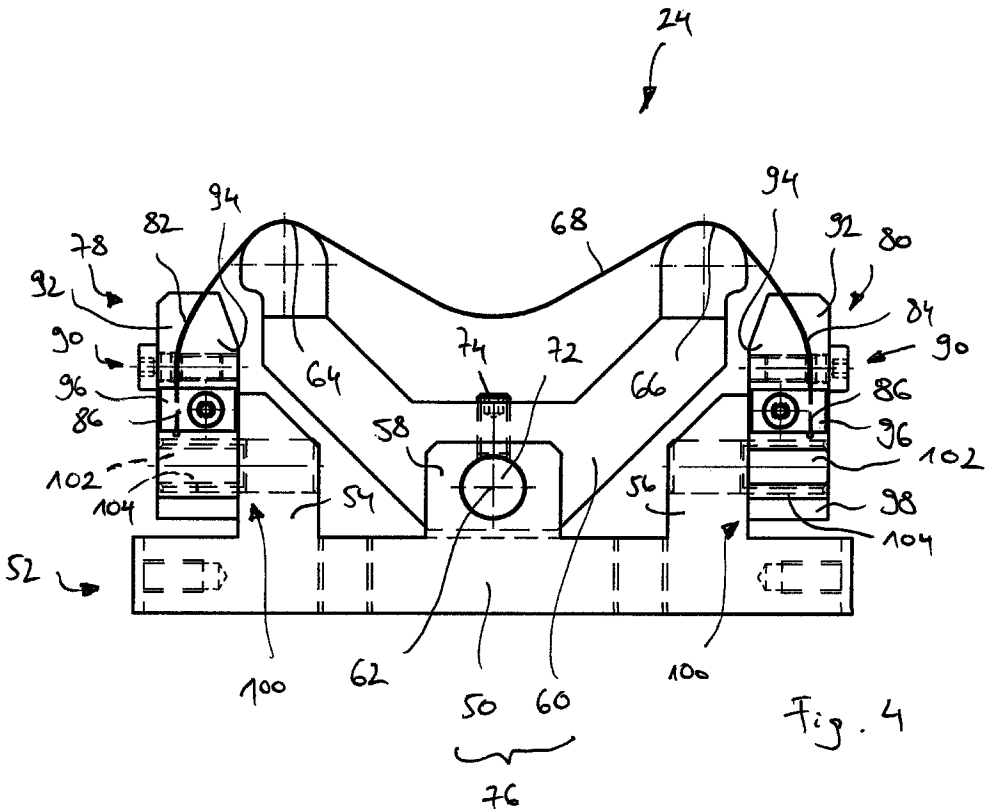
FIG. 4 is a side view of an embodiment of a pressing device.
Figure 5:
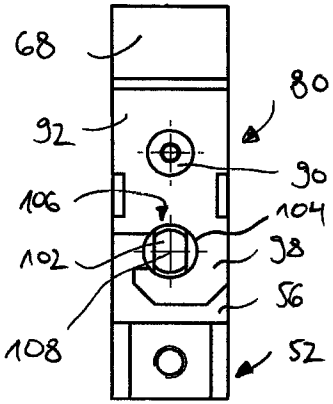
FIG. 5 is a front view of the pressing device according to FIG. 4.

As the pressure belt 68 pivots from the intermediate fitted position shown in FIG. 12 to the completely fitted position shown in FIG. 4, inner, concave belt portions 120 of the pressure belt 68 come to abut the corresponding convex bearing surfaces in the form of the support points 64 and 66.

Figure 6:
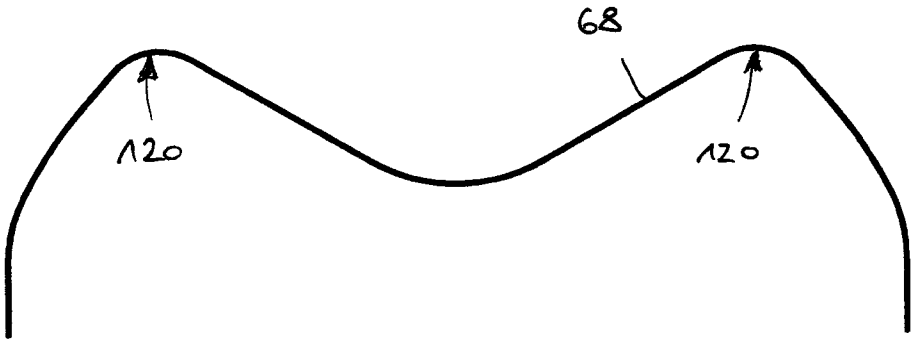
FIG. 6 is a side view of an embodiment of a pressure belt.
Figure 7:
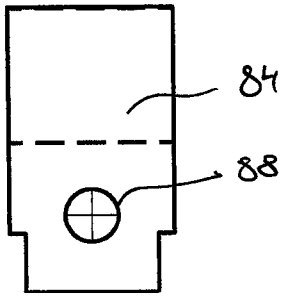
FIG. 7 is a front view of the pressing belt according to FIG. 6.
Figure 8:
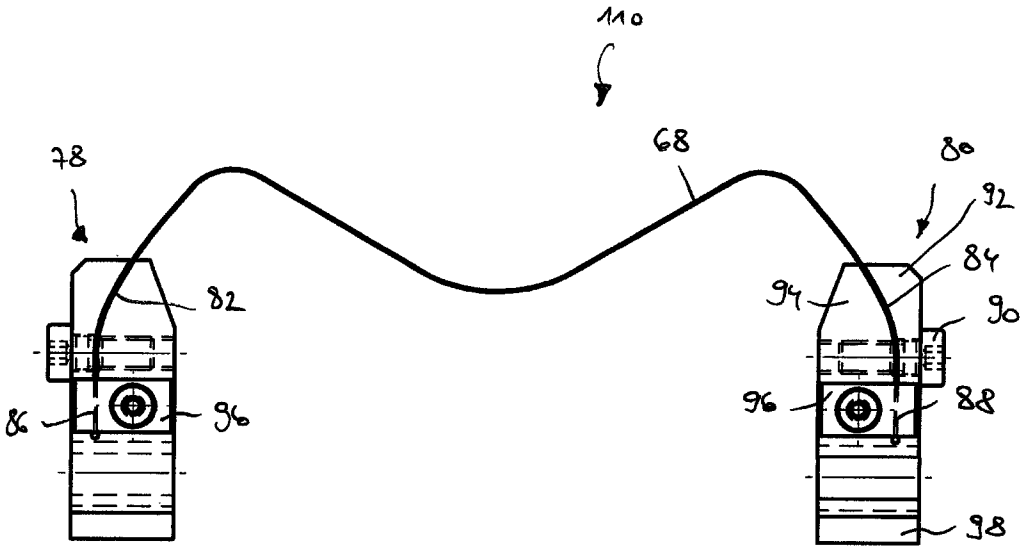
FIG. 8 is a side view of an embodiment of a fitting unit of the pressing device.

While the securing devices 78, 80 are mounted on the pressure belt carrier 76, the pressure belt 68 is deformed, in particular is bent and/or twisted, from its force-free initial shape (cf. FIGS. 6 and 7). This is elastic deformation.

While the disclosure has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present disclosure covers further embodiments with any combination of features from different embodiments described above and below. Additionally, statements made herein characterizing the disclosure refer to an embodiment of the disclosure and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A pressing device for pressing a finishing belt against a workpiece surface, comprising:

a pressure belt including pressure belt ends;

a pressure belt carrier that supports the pressure belt at two spaced-apart support points, the pressure belt releasably fastened to the pressure belt carrier;

wherein one securing device, is provided separately from the pressure belt carrier to secure each of the pressure belt ends and wherein, when in a state in which a pressure belt end is secured to the securing device, the securing device is releasably fastenable to the pressure belt carrier.

2. The pressing device according to claim 1, wherein the securing device is a clamping device.

3. The pressing device according to claim 1, wherein the securing device comprises a clamping slot, delimited by two clamping surfaces, configured to receive a pressure belt end.

4. The pressing device according to claim 3, wherein the securing device comprises delimiting elements configured to delimit the clamping slot.

5. The pressing device according to claim 1, wherein, together with the pressure belt, two securing devices form a fitting unit that fits as a whole on the pressure belt carrier and is releasable from the pressure belt carrier.

6. The pressing device according to claim 1, wherein a plug-in connection is provided for releasably connecting the securing device to the pressure belt carrier.

7. The pressing device according to claim 6, wherein the plug-in connection comprises a plug in the form of a bearing pin and a socket in the form of a bearing pin receptacle.

8. The pressing device according to claim 7, wherein the bearing pin and the bearing pin receptacle form a pivot bearing.

9. The pressing device according to claim 8, wherein an axis of the pivot bearing extends perpendicularly to an axis of rotation of a workpiece to be machined.

10. The pressing device according to claim 7, wherein the bearing pin is formed on the pressure belt carrier and the bearing pin receptacle is formed on the securing device.

11. The pressing device according to claim 7, wherein the bearing pin receptacle comprises an opening along a periphery of a bearing pin receptacle surface thereof, wherein the bearing pin has a taper, based on a cylinder shape, along a periphery of a bearing pin surface thereof and the taper and the opening are configured to join together.

12. The pressing device according to claim 1, wherein the pressure belt carrier is in multiple parts and comprises a main carrier configured to releasably fasten the securing device and an additional element that is movably mounted on the main carrier and by which the support points are provided.

13. The pressing device according to claim 12, wherein the additional element is mounted on the main carrier configured to pivot about an additional-element pivot axis.

14. The pressing device according to claim 13, wherein the additional-element pivot axis extends in parallel with an axis of rotation of a workpiece to be machined.

* * * * *